US006026619A

United States Patent [19]

Hunt

[11] Patent Number: 6,026,619

[45] Date of Patent: Feb. 22, 2000

[54] CARPET STAY-NAIL TOOL

[76] Inventor: Richard J. Hunt, 1187 Edgemont Rd., Emmett, Id. 83617

[21] Appl. No.: 09/057,618

[22] Filed: Apr. 8, 1998

[51] Int. Cl.[7] ..... H47G 27/04

[52] U.S. Cl. ..... 52/273; 52/DIG. 1; 16/4; 16/16; 411/457; 7/103; 206/343

[58] Field of Search ..... 52/273, DIG. 1, 52/211; 269/53, 904; 16/17.1, 16, 4, 5; 411/442, 443, 444, 457; 7/103; 206/343, 345; 156/304.4

[56] References Cited

U.S. PATENT DOCUMENTS

| | | | |
|---|---|---|---|
| 761,127 | 5/1904 | Andres . | |
| 3,022,979 | 2/1962 | Dahlke . | |
| 3,300,181 | 1/1967 | Spann . | |
| 3,945,609 | 3/1976 | Platek . | |
| 4,230,303 | 10/1980 | Schilz . | |
| 4,525,115 | 6/1985 | Garner, Sr. | 411/457 |
| 5,269,576 | 12/1993 | Krebs et al. . | |

*Primary Examiner*—Beth Aubrey
*Assistant Examiner*—Brian E. Glessner
*Attorney, Agent, or Firm*—Ken J. Pedersen; Barbara S. Pedersen

[57] ABSTRACT

A carpet stay-nail tool for positively holding an area of carpet to a desired location during carpet stretching and laying operations. A basic necessity during carpet laying is keeping a first section of carpet temporarily secured while the balance of the carpet is stretched and fastened to its permanent position. The invention provides a plurality of nails configured together in a row which can be pounded through the carpet into the underlayment. Subsequently, the invention can be easily pried up and reused with no discemable damage to the carpet. For safety and convenience, the tool is configured in nesting pairs of nail rows so the nail points are covered and a second nail row is readily available.

6 Claims, 5 Drawing Sheets

CARPET STAY-NAIL TOOL

BACKGROUND OF THE INVENTION

1. Field of the Invention

The invention relates generally to the field of carpet laying tools. More specifically, it is a tool for temporarily securing carpet to an underlayment during the carpet laying process.

2. Related Art

In the course of laying wall to wall carpet, there exists a need for a means to temporarily secure a portion of the loose carpet in a certain position while an opposite edge of the carpet is stretched and finally attached. The need commonly occurs in doorways where it is necessary or desirable to stretch and secure the balance of the carpet throughout the room before trimming the carpet at the doorway to an end or for a neat seam with other carpet. The need occurs, too, in replacing adjacent carpet sections and repairing carpet seams. Carpet layers have long employed a number of individual "loose" nails for this purpose, sometimes with the nails driven through a scrap of carpet or padding lying on top of the carpet to be installed. This "loose nail" technique is time-consuming, unnecessarily damaging to the carpet back because it is stressed or even broken as each nail is removed, and there is good potential for a nail or nails to be left under the carpet, requiring removal and repair.

Related art described in U.S. Pat. No. 3,300,181 to Spann and in U.S. Pat. No. 3,945,609 to Platek disclose devices which engage adjacent carpet sections from the top of the carpet and mechanically draw the adjacent sections together to create or repair a seam. The devices are a variety of carpet stretchers which vary from the present invention in that they do not operate to secure an area of carpet temporarily to a certain position. They require a second carpet section and secure the carpet sections relative to each other rather than to a certain position relative to the floor or room.

Schilz in U.S. Pat. No. 4,230,303 discloses a "stay nail bar" which engages a single carpet section and secures it temporarily to a certain position. It is removably locked into position between opposite walls or within a door jamb and engages the carpet from above with penetrating prongs. While this device performs to a similar purpose, it does not disclose the present invention because it requires lateral support and does not penetrate underlayment.

It is an object of the present invention to provide simple and effective means to positively and temporarily secure an area of carpet to a certain position. It is a further object for said means to be inexpensive to procure and safe and efficient to operate. It is yet another object of the invention to leave the carpet and house undamaged. It is yet another object of the invention to provide an unobstructed area at the edge of the carpet for subsequent operation such as trimming and sewing.

SUMMARY OF THE INVENTION

The present invention is a stay-nail bar comprised, in its simplest embodiment, of a longitudinal member having a plurality of parallel nails protruding from it. The bar could be of any material capable of having nails affixed to, or through, it and sufficiently rigid and strong to convey the force of a hammer applied above the bar to the plurality of nails below the bar with adequate resultant force to drive the nails into the floor. The invention is practiced by first positioning the carpet section to its desired location, positioning the stay-nail bar above the carpet section to be temporarily fastened, and, then, hammering the stay-nail bar along its length, thus driving the nails through the carpet and into the underlayment. Upon completion of the interim carpet-laying processes, the stay-nail bar is easily removed by prying one or both ends.

The advantage of the present invention over the traditional method of driving a multitude of single nails through the carpet into the floor, or first through a scrap of carpet, is that of convenience. The practitioner need not find and handle a number of nails and then drive and, finally, pull a number of nails. Rather, the practitioner handles, drives, and removes one, two, or some small number of bars but not a multitude of nails.

The advantage of the present invention over related art such as Schilz is in its simplicity. The invention requires no set-up beyond moving it and the carpet to the desired position. The invention is simply driven into the underlayment and, later, pried up for reuse. Compared to related art, the invention is inexpensive, essentially maintenance free, very durable, and very fast and simple to use.

The present invention in an alternative embodiment includes presenting the bars in pairs, particularly bars constructed to nest within each other. So configured, the invention is much safer to carry and store because the sharp nails points are nested within or near the opposite bar and not exposed. Also, the pair of bars provides a means of adjustment over an area to be secured. A plurality of bars can secure a larger carpet section and may be spaced apart or overlapped to fit a certain length.

DESCRIPTION OF THE PREFERRED EMBODIMENTS

Figure 1:
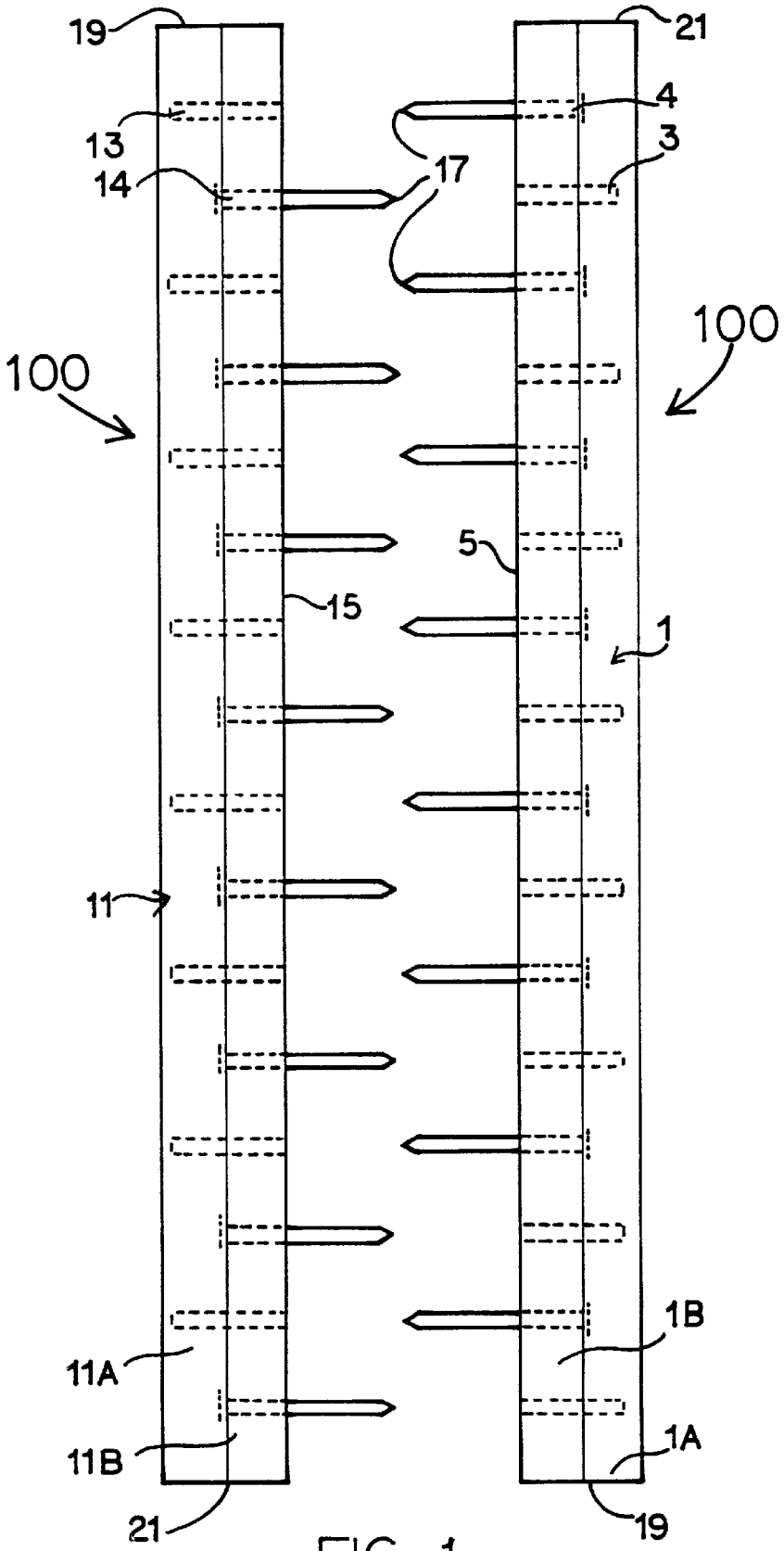
FIG. 1 is a side view of a pair of stay-nail bars configured to nest together.
Figure 2:
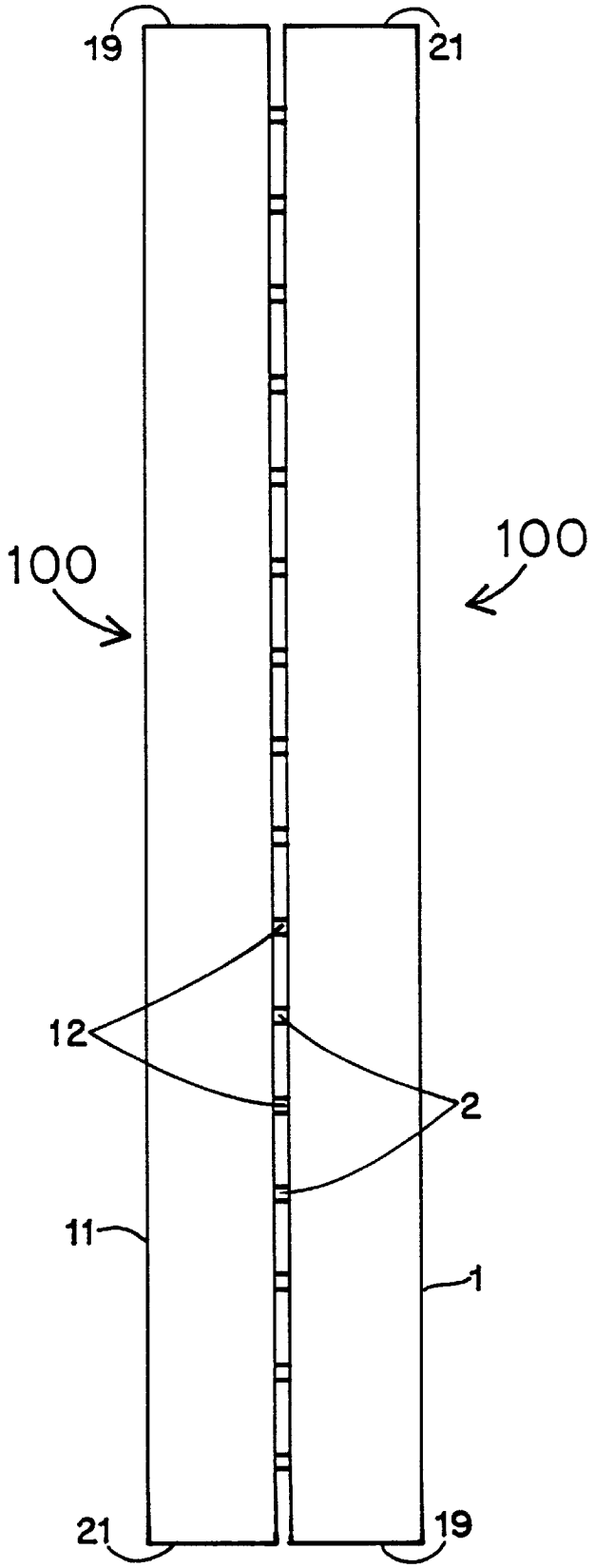
FIG. 2 is a side view of a pair of stay-nail bars nested together.

Referring to FIGS. 1 and 2, there is presented one, preferred embodiment, but not the only embodiment, of the stay-nail tool. Within these figures, and the preferred embodiment, the stay-nail bars are configured in nesting pairs 1, 11. Each bar 100 of FIGS. 1 and 2 is essentially identical to the other and they are shown inverted, each to the other, so they may be nested for carrying and storage. Nesting is accomplished by matching each nail 2, 12 to a corresponding hole 3, 13 in the opposing longitudinal member. Each bar's nails 2, 12, with their sharp distal points 17, extend from the first surface 5, 15 of the bar 100, and each bar's holes 3, 13 extend into first surface 5, 15, so that two bars may be nested together with their first surfaces 5, 15 facing each other. As can be seen in FIG. 1, holes 3, 13 are located between each two nails of the row of nails and an additional hole is between the first end 19 of each bar and the nail nearest the first end 19. This way, as is shown in FIGS. 1 and 2, the bars may be inverted end-to-end and nested.

Holes 3, 13 correspond not only in distance apart to match nails but also match the nails in diameter and depth so that the nails may be slideably received and the nested tools may be conveniently pulled apart by hand. The stay-nail bars 1, 11 need not be identical to nest, for example two bars could have different numbers of nails, but, obviously, every nail 2, 12 must correspond to some form of hole or other recess.

Alternatively, one or more nails may extend close to, but not into the longitudinal member, thus shielding but not completely covering the nail points.

Referring still to FIGS. 1 and 2, one method of fabricating the stay-nail bars 1, 11 is to employ, for each bar 1, 11 two similar longitudinal members 1A, 1B, 11A, 11B per each bar 1, 11. Within the eventual "lower" member 1B, 11B, holes 4, 14 are drilled for receiving nails 2, 12 and the nails are so installed. Then the second, "upper" member 1A, 11A is securely and permanently affixed over the lower member 1B, 11B and heads of the nails. This second member 1A, 11A functions to keep the nails properly spaced, straight, and parallel and, further, stiffens the bar 1, 11 and better distributes the force of a hammer when in use. A distance between the nails in the range of one to five inches, preferably about two inches, has proven to be effective in most cases. The nesting capability is achieved by drilling holes corresponding to the nails. Other methods and materials could be used to accomplish a similar product.

Figure 3:
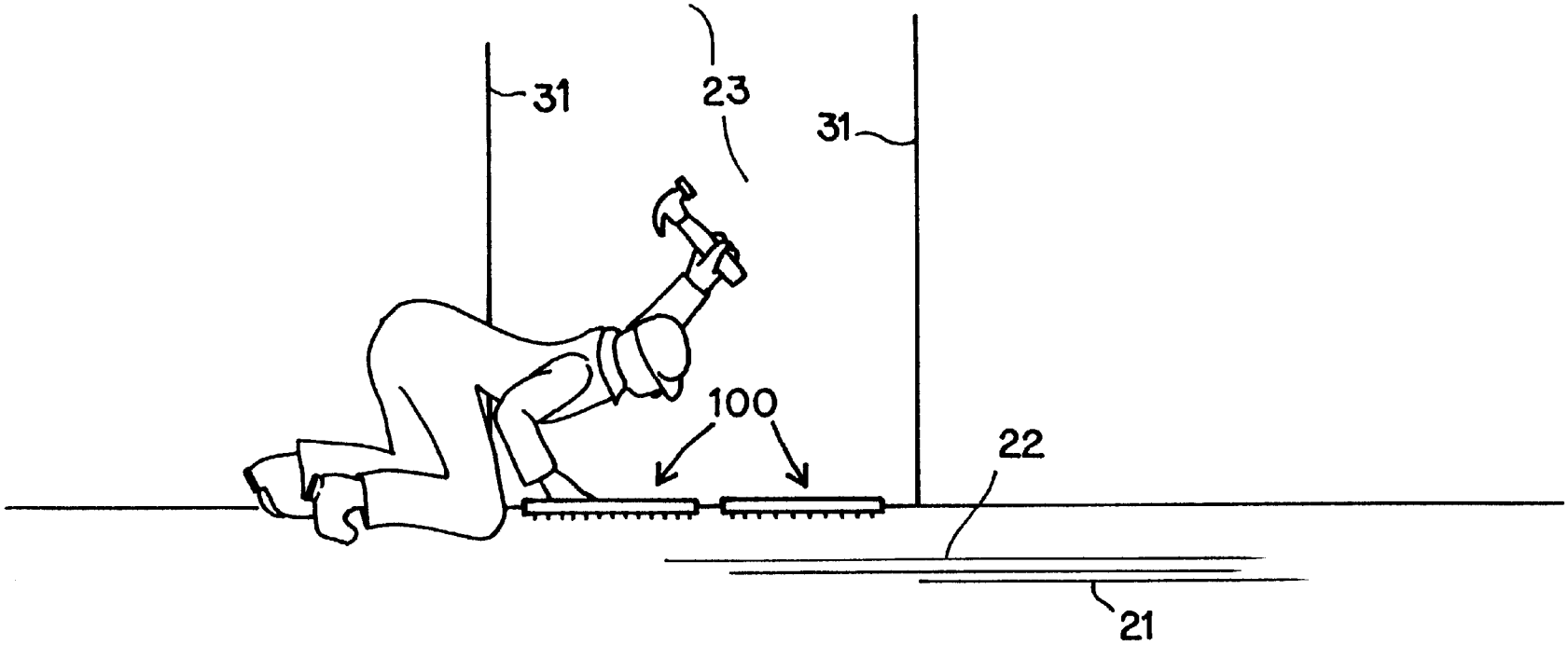
FIG. 3 is a perspective of a pair of the inventive bars during installation.
Figure 4:
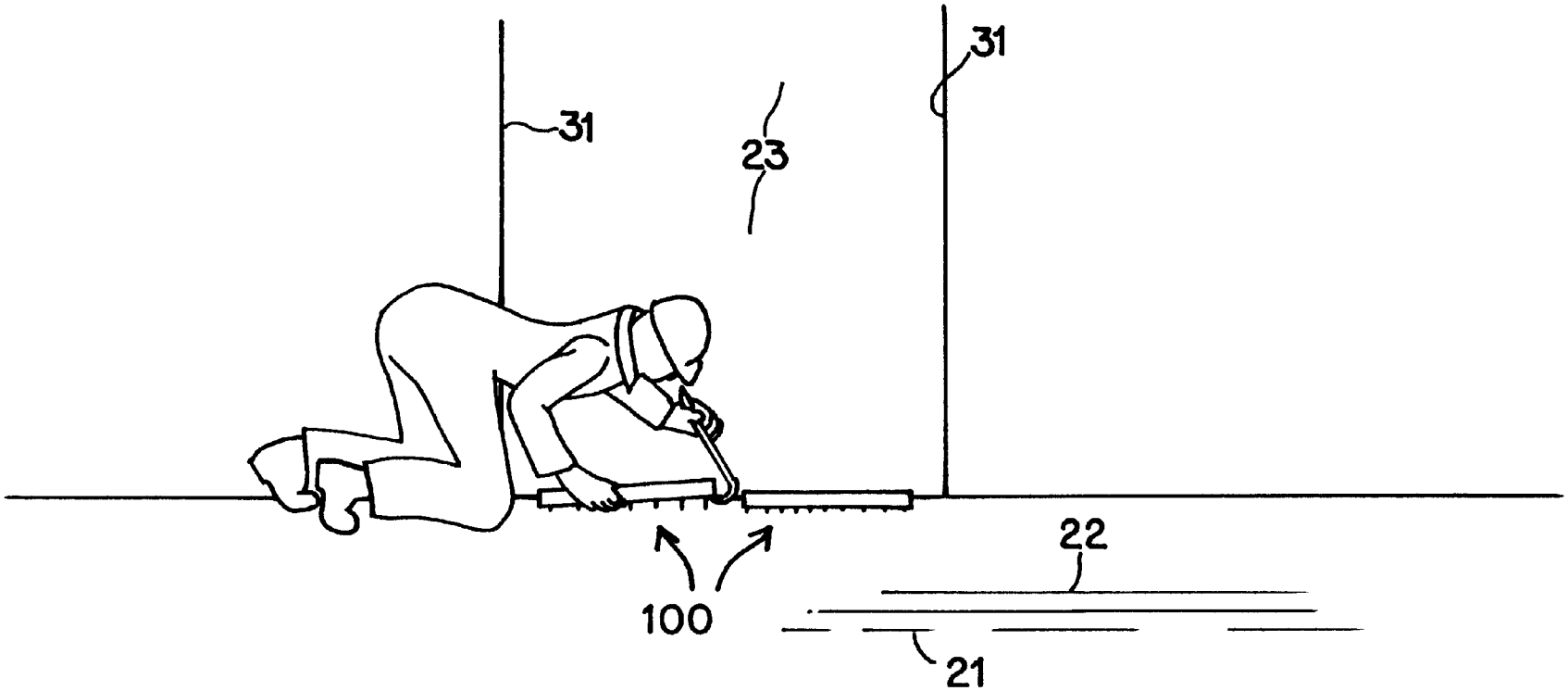
FIG. 4 is a perspective of a pair of the inventive bars during removal.

Referring now to FIGS. 3 and 4, the invention is practiced by first bringing the carpet 22 to the desired location on the underlayment 21, the "desired location" normally being a few inches away from the edge of the carpet to provide work space at the carpet edge. Very often the desired location is in a doorway 23 having doorjambs 31. The doorway is where seams are normally made and the invention is normally used as an interim fastening system to facilitate the final attachment of the carpet, be it seam or otherwise. Once positioned, the carpet 22 is nailed to the underlayment by means of the invention 100 which is held nails down and pounded with a hammer so that the nails 2 or 12 are driven through the carpet 22 and securely into the underlayment 21. After the carpet is completely finally secured, the invention 100 is pried up and pairs are nested, ready for reuse.

Figure 5:
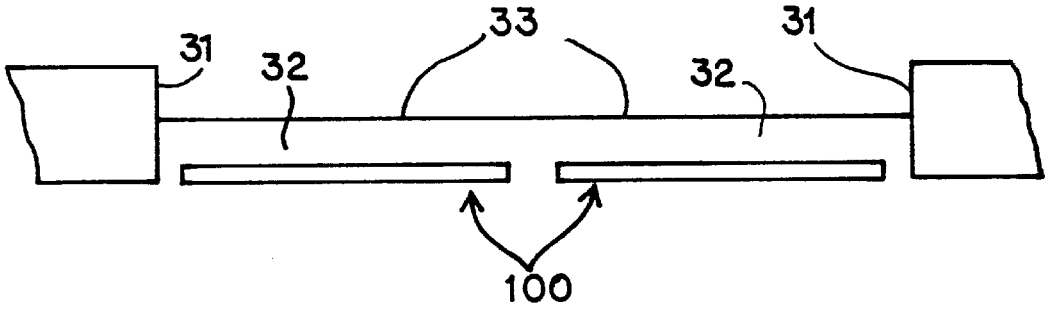
FIG. 5 is a schematic top view of two end-to-end stay-nail bars according to the invention, installed between two vertical surfaces.
Figure 6:
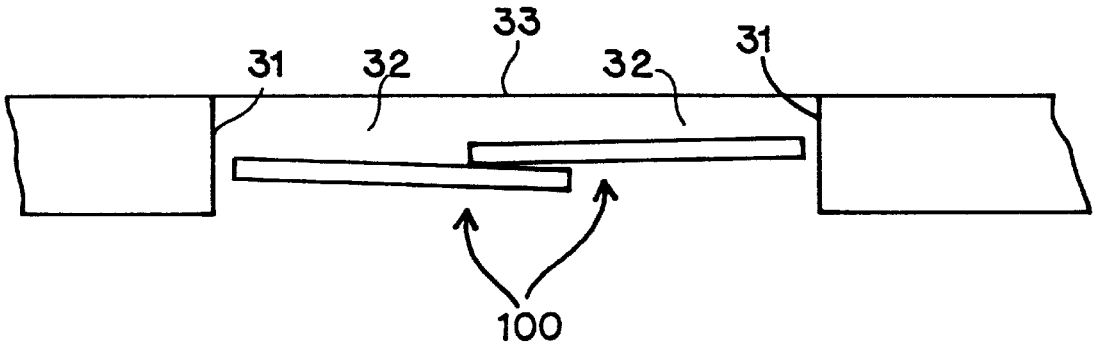
FIG. 6 is a schematic top view of two overlapped stay-nail bars between two vertical surfaces.

A particular advantage of the invention is its inherent adjustability and adaptability. The length of the longitudinal members 1, 11 of the preferred embodiment is about 16" to 18". As stated previously, the invention is intended to be employed, among other places, in doorways between door jambs, with the stay-nail bars being generally parallel to the plane of the doorway. FIGS. 5 and 6 illustrate this configuration. Because most doorways are between 32" to 36" wide, a pair of stay-nail bars can readily secure carpet over that distance. If, as in FIG. 5, the distance between doorjambs 31 is wider than the combined length of the end-to-end bars 100, the doorway is probably only slightly wider and the bars can be arranged to cover that distance with only short, inconsequential gaps between them. If, as in FIG. 6, the pair of stay-nail bars 100 is too long, that is, their combined length exceeds the distance between doorjambs 31, the length of each bar at about 17" is near one-half the doorway width and the bars 100 can be lapped so they fit within the doorway 23. If the gaps are too long, more bars can be employed.

Preferably, the ends of the stay-nail bar do not touch either doorjamb leaving a space between at least one, and preferably both, of the ends of the stay-nail bar and the doorjambs. The stay-nail bar is also preferably positioned on the carpet so that it does not cover the carpet edge 32. Instead, two to four inches of the carpet edge preferably extends beyond the stay-nail bar to provide carpet material for trimming, sewing, gluing, or other relevant task to create a desirable carpet seam 33.

Preferably, the stay-nail bar 100, in use, is a simple, economical tool without any moving parts. For example, the stay-nail bar 100 does not require any joints or pivoting members, any members that slide relative to other of its members or any locking mechanisms for holding any moving parts. When two stay-nail bars are nested together for storage and transport, the two bars may be considered to be fastened together by the frictional engagement of the nails in the holes and/or by other optional fasteners. Also, the two bars may be considered to move relative to each other for nesting and unnesting, but no other moving parts are necessarily required.

Although this invention has been described above with reference to particular means, materials and embodiments, it is to be understood that the invention is not limited to these disclosed particulars, but extends instead to all equivalents within the scope of the following claims.

I claim:

1. A system for temporarily fastening carpet comprising:

(a) a flooring underlayment;

(b) a carpet lying on top of said underlayment and having a carpet edge;

(c) a stay-nail bar consisting of a longitudinal member and a row of nails extending perpendicularly from said longitudinal member, wherein said stay-nail bar is positioned on top of said carpet a distance from the carpet edge and the row of nails extends through the carpet into the underlayment and wherein said longitudinal member has sufficient rigidity to transfer a blow on said longitudinal member to said row of nails adequate to drive a plurality of the nails into the underlayment; and (d) a doorway having two vertical sides; wherein said stay-nail bar is positioned between said two vertical sides without extending to and without touching either side and is positioned said distance from the carpet edge so that the stay-nail bar does not cover the carpet edge to provide access to the carpet edge.

2. A system as in claim 1, further comprising a plurality of stay-nail bars wherein said stay-nail bars are configured generally end-to-end in a line between said two vertical sides wherein said bars are spaced to increase the horizontal distance covered by the bars.

3. A system as in claim 1, further comprising a plurality of stay-nail bars wherein said stay-nail bars are configured generally end-to-end in a line between said two vertical sides wherein said bars are overlapped to decrease the horizontal distance covered by the bars.

4. A temporary carpet-fastening method comprising:

(a) placing a carpet section at a desired position over a flooring underlayment;

(b) placing two stay-nail bars over the carpet, the stay-nail bars each having a longitudinal member and a plurality of nails configured to extend in a row perpendicularly from said longitudinal member wherein said longitudinal member has sufficient rigidity to transfer a blow on the longitudinal member to the nails adequate to drive a plurality of the nails some distance into the underlayment;

(c) positioning said stay-nail bars in a nails-down position over the carpet at the desired location; and (d) hammering the top of the stay-nail bars and, thus, driving the nails through the carpet and into the underlayment;

wherein the step of positioning the bars comprises placing the two stay-nail bars over the carpet between two vertical surfaces and positioning the bars in a nails-down position, end-to-end, generally in a line and not touching said vertical surfaces, such that spaces between said ends are variable to extend the combined horizontal coverage of the bars; and wherein the two stay-nail bars have holes adapted to receive nails of another stay-nail bar and wherein the carpet-fastening method further comprises prying the two bars up from the underlayment and the carpet and nesting the two bars by inserting the nails of each bar slideably into the holes of the other bar.

5. A temporary carpet-fastening method comprising:

(a) placing a carpet section at a desired position over a flooring underlayment;

(b) placing two stay-nail bars over the carpet, the stay-nail bars each having a longitudinal member and a plurality of nails configured to extend in a row perpendicularly from said longitudinal member wherein said longitudinal member has sufficient rigidity to transfer a blow on the longitudinal member to the nails adequate to drive a plurality of the nails some distance into the underlayment;

(c) positioning said stay-nail bars in a nails-down position over the carpet at the desired location; and (d) hammering the top of the stay-nail bars and, thus, driving the nails through the carpet and into the underlayment;

wherein the step of positioning the bars comprises placing two of said stay-nail bars over the carpet between two vertical surfaces and positioning the bars in a nails-down position, generally in a line with ends of the bars overlapping to reduce the combined horizontal length of the bars; and wherein the two stay-nail bars have holes adapted to receive nails of another stay-nail bar and wherein the carpet-fastening method further comprises prying the two bars up from the underlayment and the carpet and nesting the two bars by inserting the nails of each bar slideably into the holes of the other bar.

6. A pair of carpet installation stay-nail bars, each bar consisting essentially of:

a longitudinal member with a first outer surface and an opposing second outer surface and a first end and a second end; and a plurality of nails affixed in the longitudinal member and extending in a row perpendicularly from said longitudinal member first surface, each nail having a sharp distal point pointing out away from the first surface;

wherein the longitudinal member has sufficient rigidity to transfer a blow on the longitudinal member second surface to said nails adequate to drive the plurality of nails through a carpet and some distance into a flooring underlayment;

wherein each bar has holes extending into said first surface, wherein holes correspond to every nail of the opposing stay-nail bar and slidably and releasably receive the nails of the opposing bar to nest the two bars together with their first surfaces facing each other so that no sharp distal points are exposed when the two bars are stored, wherein the holes of the bars are adapted to release the nails received therein conveniently by hand and without tools;

wherein arrangement of said nails and said holes is essentially identical on each of the two bars, and consists of one of said holes being between each two nails in said row of nails, and an additional one of said holes being between the first end of the longitudinal member and the nail nearest said first end, so that the two bars are inverted end-to-end for nesting.

* * * * *